US009422079B2

(12) United States Patent
Bitner

(10) Patent No.: US 9,422,079 B2
(45) Date of Patent: Aug. 23, 2016

(54) FRANGIBLE SHIPPING CARTON AND ASSOCIATED METHODS

(71) Applicant: Watson Laboratories, Inc., Salt Lake City, UT (US)

(72) Inventor: John Bitner, Sugar Grove, IL (US)

(73) Assignee: Watson Laboratories, Inc., Salt Lake City, UT (US)

( * ) Notice: Subject to any disclaimer, the term of this patent is extended or adjusted under 35 U.S.C. 154(b) by 0 days.

(21) Appl. No.: 14/943,884

(22) Filed: Nov. 17, 2015

(65) Prior Publication Data

US 2016/0068299 A1 Mar. 10, 2016

Related U.S. Application Data

(62) Division of application No. 12/945,231, filed on Nov. 12, 2010, now Pat. No. 9,216,838, which is a division of application No. 11/743,583, filed on May 2, 2007, now Pat. No. 9,027,826.

(51) Int. Cl.
*B65D 5/54* (2006.01)
*B65B 69/00* (2006.01)

(52) U.S. Cl.
CPC ..... *B65D 5/542* (2013.01); *B65B 69/00* (2013.01); *B65D 5/54* (2013.01); *B65D 5/5445* (2013.01); *B65D 2571/0045* (2013.01); *B65D 2571/00574* (2013.01)

(58) Field of Classification Search
CPC ..... B65D 2571/00574; B65D 5/542; B65D 5/54; B65D 5/541; B65D 2571/0045; B65D 5/5445
USPC ..... 229/235, 237, 239, 101.1, 160.2, 240; 206/736, 738, 453, 586; 53/381.1
See application file for complete search history.

(56) References Cited

U.S. PATENT DOCUMENTS 1,168,565 A * 1/1916 Rosenwald ..... B65D 5/12 217/123
2,145,430 A * 1/1939 New ..... B65D 5/5445 209/498
2,407,415 A 9/1946 Graziano et al.
(Continued)

FOREIGN PATENT DOCUMENTS

JP 2002-68174 3/2002

OTHER PUBLICATIONS

N. Lindner, International Preliminary Report on Patentability in PCT/US08/60484, Nov. 3, 2009, 6 pages, International Bureau of WIPO, Geneva, Switzerland.
(Continued)

*Primary Examiner* — Christopher Demeree
(74) *Attorney, Agent, or Firm* — Florek & Endres PLLC

(57) ABSTRACT

A selectively frangible shipping carton for storing and shipping goods comprises at least one side wall joining a top wall and a bottom wall. A path of weakness extends around a periphery of the carton through at least a portion of the side wall. The path of weakness enables a user to manually separate the carton into at least two portions: an upper portion including the top wall and a lower portion including the bottom wall. A pair of lines of weakness extends upwardly relative to the path of weakness and terminates at or adjacent the top wall. A grip flap defined in the side wall between the pair of lines of weakness, the grip flap being graspable by the user when separating the carton into the at least two portions.

9 Claims, 3 Drawing Sheets

(56) References Cited

U.S. PATENT DOCUMENTS

| | | | |
|---|---|---|---|
| 2,751,964 | A | 6/1956 | Guyer et al. |
| 2,967,610 | A | 1/1961 | Sheerin et al. |
| 3,136,474 | A | 6/1964 | Schaus et al. |
| 3,276,665 | A | 10/1966 | Rasmussen et al. |
| 3,276,666 | A | 10/1966 | Johnson et al. |
| 3,531,045 | A | 9/1970 | Johnson et al. |
| 3,884,348 | A | 5/1975 | Ross et al. |
| 4,113,100 | A | 9/1978 | Soja et al. |
| 4,553,666 | A | 11/1985 | Gullikson |
| 4,648,509 | A | 3/1987 | Alves |
| 4,784,271 | A | 11/1988 | Wosaba et al. |
| 4,865,187 | A | 9/1989 | Zulauf et al. |
| 5,098,757 | A | 3/1992 | Steel |
| 5,299,733 | A | 4/1994 | Werth |
| 5,464,151 | A | 11/1995 | Parker et al. |
| 5,507,432 | A | 4/1996 | Cyr |
| 5,651,497 | A | 7/1997 | Ventura et al. |
| 5,853,120 | A | 12/1998 | McLeod et al. |
| 5,979,749 | A | 11/1999 | Bozich |
| 6,073,833 | A | 6/2000 | Desrosiers et al. |
| 6,102,277 | A | 8/2000 | Krapohl et al. |
| 6,189,780 | B1 | 2/2001 | Kanter |
| 6,402,016 | B1 | 6/2002 | Lee |
| 6,435,351 | B1 | 8/2002 | Gibb |
| 6,478,159 | B1 | 11/2002 | Taylor et al. |
| 6,510,982 | B2 | 1/2003 | White et al. |
| 6,976,588 | B2 | 12/2005 | Wischusen et al. |
| 7,066,379 | B2 | 6/2006 | McLeod et al. |
| 7,175,066 | B2 | 2/2007 | Varanasi |
| 2005/0051573 | A1 | 3/2005 | Crosland et al. |
| 2005/0092822 | A1 | 5/2005 | Sutherland |
| 2005/0189406 | A1 | 9/2005 | Welchel et al. |
| 2006/0054676 | A1 | 3/2006 | Wischusen, III |
| 2006/0254942 | A1 | 11/2006 | Cargile, Jr. |
| 2006/0255105 | A1 | 11/2006 | Sweet |

OTHER PUBLICATIONS

B.R. Copenheaver, International Search Report on Patentability in PCT/US08/60484, Oct. 14, 2008, 4 pages, ISA/US, Alexandria, Virginia.

B.R. Copenheaver, Written Opinion of the International Searching Authority in PCT/US08/60484, Oct. 14, 2008, 5 pages, ISA/US, Alexandria, Virginia.

* cited by examiner

FRANGIBLE SHIPPING CARTON AND ASSOCIATED METHODS

This application is a divisional application of currently pending U.S. patent application Ser. No. 12/945,231, filed Nov. 12, 2010, which is a divisional application of U.S. patent application Ser. No. 11/743,583, filed May 2, 2007, which issued as U.S. Pat. No. 9,027,826 on May 12, 2015.

BACKGROUND OF THE INVENTION

1. Field of the Invention

The present invention relates generally to cartons for storing, repackaging, distributing and transporting goods. More particularly, the present invention relates to shipping cartons that can be relatively easily opened by a user without the use of sharp implements.

2. Related Art

Cartons for storing and shipping goods have been provided in a wide range of configurations. While specific sizes and shapes can vary, many modern cartons are generally rectangular in shape and are formed from corrugated cardboard, fiberboard, etc. Corrugated cardboard has been a popular material because of its relatively light weight and the ease with which it can be manufactured. Also, corrugated cardboard has proved a very useful component of streamlined packaging systems. While the art of constructing cartons from cardboard materials is fairly well advanced, there are a number of limitations in the state of the art.

For example, because cardboard shipping cartons often must withstand rough handling during shipping and transport, the shipping cartons should be capable of remaining intact until the carton arrives at a location where it is desired to open the carton and access the goods inside. In nearly all cases, operators at this end location utilize some type of very sharp blade, such as a box cutter, utility knife or the like, to either cut the carton itself open, or to cut strapping tape that secures flaps of the carton in a closed configuration.

Unfortunately, however, operators can become nonchalant about such blades after using them in a repetitive routine for extended periods of time, and can (and often do) inadvertently cut through the cartons and damage the goods within the carton, leading to loss of product. Also, such operators risk cutting themselves or others while opening the cartons; which, of course, is an undesirable situation that can pose a serious health threat and lead to the risk of significantly increased operator downtime. In addition, these operators can experience significant discomfort and/or injury as a result of, or resulting in, conditions such as carpal tunnel syndrome. Utilizing sharp blades to open containers can also prove inefficient, as the operator often must attempt to cut through a corrugated carton multiple times before the cut is sufficiently deep or long to open the carton.

Thus, while it is desirable to provide a shipping carton that can consistently withstand the trials of packing and shipping goods, it would also be desirable to provide such a carton that can be relatively easily opened by an operator without requiring that the operator wield a sharp-bladed instrument.

SUMMARY OF THE INVENTION

The invention provides a selectively frangible shipping carton for storing and shipping goods, including: at least one side wall joining a top wall and a bottom wall, and a path of weakness extending around a periphery of the carton through at least a portion of the side wall. The path of weakness can enable a user to manually separate the carton into at least two distinct, separately functional portions: an upper disposable portion including the top wall and a lower portion including the bottom wall. After separation, the lower portion can be used to pick and place shipping orders, while the upper portion is generally discarded or recycled immediately after separation. A pair of lines of weakness can extend upwardly relative to the path of weakness and can terminate short of, at, or adjacent the top wall. A grip flap can be defined in the side wall between the pair of lines of weakness, the grip flap being graspable by the user when separating the carton into the two distinct, functional portions.

In accordance with another aspect of the invention, a selectively frangible shipping carton for storing and shipping goods is provided, including at least one side wall, and a path of weakness extending around a periphery of the carton through at least a portion of the side wall. The path of weakness can enable a user to manually separate the carton into at least two distinct portions: an upper disposable portion and a lower portion serving as an organizer for products as the products are processed further for distribution. The path of weakness can have a substantially constant elevation relative to a lowermost point of the carton. A pair of lines of weakness can be in communication with and can extend upwardly from the path of weakness, the pair of lines of weakness defining therebetween a grip flap in the side wall. The grip flap can be manually configurable by the user into a graspable portion having a depth at least twice a thickness of the side wall. The graspable portion can provide a secure gripping interface to aid the user in manually separating the carton into the at least two distinct portions.

In accordance with another aspect of the invention, a selectively frangible shipping carton for storing and shipping goods is provided, including at least one side wall joining an upper portion and a lower portion, and a path of weakness extending around a periphery of the carton through at least a portion of the side wall. The path of weakness can enable a user to manually separate the upper portion and the lower portion one from another. The path of weakness can have a substantially constant elevation relative to a lowermost point of the lower portion. At least one line of weakness can be formed in the side wall and an access flap can be defined adjacent the line of weakness. The access flap can allow the user to insert a portion of the user's hand within the carton to securely grasp the side wall when manually separating the carton into the at least two portions.

In accordance with another aspect of the invention, a method for manually separating an upper portion of a shipping carton from a lower portion of the shipping carton to expose a storage area of the shipping carton is provided, including: separating a grip flap from a side wall of the carton by rupturing a pair of lines of weakness defining the grip flap in the side wall; rolling or folding the grip flap into a graspable portion having a depth at least twice a thickness of the side wall; and applying a force to the side wall, through the graspable portion, to manually separate an upper portion of the carton from a lower portion of the carton along a path of weakness formed in the side wall between the upper portion and the lower portion.

In accordance with another aspect of the invention, a selectively frangible shipping carton for storing and shipping goods is provided, including at least one side wall, and a path of weakness extending around a periphery of the carton through at least a portion of the side wall. The path of weakness can enable a user to manually separate the carton into at least two distinct portions: an upper portion and a lower portion. A line of weakness can be spaced from the path of weakness and can extend generally parallel to the path of weakness. An access flap can be defined in the side wall between the line of weakness and the path of weakness. The access flap can allow the user to insert at least a portion of the user's hand within the carton to allow the user to securely grasp the side wall when separating the carton into the at least two portions.

In accordance with another aspect of the invention, a selectively frangible shipping carton for storing and shipping goods is provided, including at least one side wall, and a path of weakness extending around a periphery of the carton through at least a portion of the side wall. The path of weakness can enable a user to manually separate the carton into at least two portions: an upper portion and a lower portion. The path of weakness can include a weakened section having a cohesive strength that is less than a cohesive strength of other portions of the path of weakness.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1A:
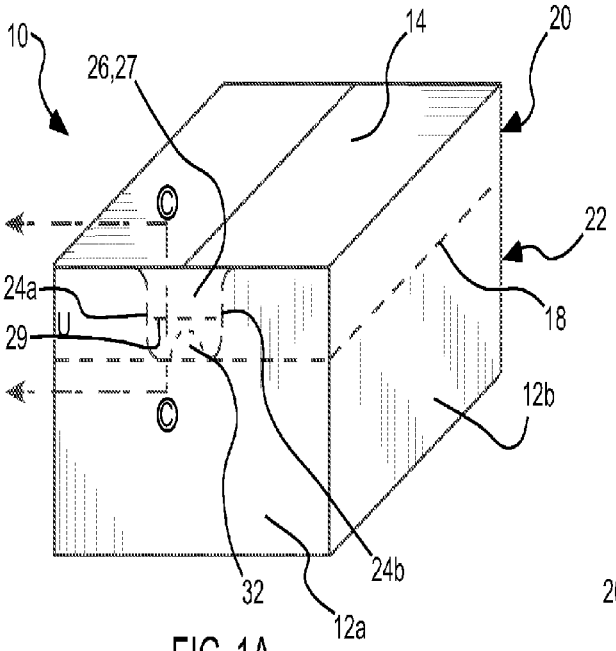
FIG. 1A is a perspective view of a shipping carton in accordance with an embodiment of the present invention.

Before the present invention is disclosed and described, it should be understood that this invention is not limited to the particular structures, process steps, or materials disclosed herein, but is extended to equivalents thereof as would be recognized by those of ordinarily skill in the relevant arts. It should also be understood that terminology employed herein is used for the purpose of describing particular embodiments only and is not intended to be limiting in any way.

It must be noted that, as used in this specification and the appended claims, the singular forms "a" and "the" include plural referents, unless the context clearly dictates otherwise. Thus, for example, reference to a "side wall" can, but does not necessarily, include one or more of such side walls.

Definitions

In describing and claiming the present invention, the following terminology will be used in accordance with the definitions set forth below.

As used herein, the term "path of weakness" is to be understood to refer to an area formed or created in a material of a shipping carton that is relatively less strong than a nominal strength of the same material. For example, when a path of weakness is formed in a sheet of cardboard, the path of weakness will exhibit some lessened strength characteristic than other, non-treated or non-affected areas of the cardboard. The corrugated cardboard will tend to fracture, bend or tear more easily in the path of weakness than in the non-treated or non-affected areas of the cardboard.

The manner in which a path of weakness is formed or created in a carton material can vary. Depending upon the embodiment being discussed, the path of weakness can be created by forming a crease in the carton material, by forming a series of perforations in the material, a series of slits in the material, a single slit, a fold, etc.

It is to be understood that the graphical manner in which the paths, lines or areas of weakness are illustrated herein does not necessarily correlate with the manner in which the path, line or area will actually appear. For example, the dashed line 18 in FIG. 1 illustrates the general layout and location of the path of weakness discussed in accordance with that embodiment. However, the path of weakness 18 may or may not include a series of slits that would be visibly similar to the dashed line shown. In other words, a series of "pinpoint" perforations would appear quite different visibly than a series of dash-like slits, even though both types of structure could be used to form a path of weakness.

The terms "path of weakness," "line of weakness," "area of weakness," "section of weakness," etc., can be used interchangeably and have generally the same meaning from a material properties standpoint. However, an attempt has been made to consistently refer herein to various components of the present cartons using the same term each time reference is made. Thus, for example, the "path" of weakness shown in the various embodiments that circumscribes the periphery of the cartons is generally consistently referred to as a "path," while the "line" of weakness forming the grip flap or access flap is generally consistently referred to as a "line," despite the fact that the path and the line can be formed in the material of the carton in exactly the same manner.

It is to be understood that, when used herein, the term "line" or "path" can refer to a structure that is linear, curvilinear, angular, circuitous, etc. Thus, a line or path is not necessarily straight or curved, unless specific reference in the written specification or drawings dictates otherwise.

When a "pair of lines" is discussed herein, it is to be understood that a pair of lines can be formed by one continuous line that includes portions that are parallel to one another. For example, a "U-shaped" line or path can include a pair of legs or uprights that are substantially parallel to one another: these parallel portions can be referred to collectively herein as a "pair of lines."

Lines, paths or areas of weakness are sometimes discussed herein as reducing a "cohesive strength" of a side wall of a shipping carton. In these embodiments, the lines, paths or areas of weakness will act as an initiation area for fracturing or tearing in the side wall of the carton. Not all lines, paths or areas of weakness will necessarily appreciably reduce the cohesive strength of a side wall. For example, perforations, slits or cuts will generally reduce a cohesive strength of a side wall. However, creases or folds formed in the side wall may or may not reduce the cohesive strength of the side wall, even though such creases or folds will likely reduce a bending strength of the side wall (e.g., the side wall will easily fold at these points when subject to a bending load).

When a "path," "line," "section" or "area" of weakness is discussed herein, it is to be understood that weakness introduced by the path, line, etc., in a wall of a carton is generalized along the path, line, etc. Thus, a conventional perforated line formed in a paperboard product creates a line of weakness in the paperboard, even though there are sections of the perforated line (e.g., uncut or undamaged portions between holes, slits, cuts, etc.) that include undamaged (e.g., non-weakened) paperboard.

As used herein, the term "substantially" refers to the complete or nearly complete extent or degree of an action, characteristic, property, state, structure, item, or result. For example, a line of weakness that reduces a cohesive strength of a side wall to "substantially" zero means that the cohesive strength is either zero or so nearly zero that a typical person would be unable to appreciate the difference. The exact allowable degree of deviation from absolute completeness may in some cases depend upon the specific context. However, generally speaking, the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, an area of a carton side wall that is "substantially free of" sections of weakness would either completely lack any weakened sections, or so nearly completely lack weakened sections that the effect would be the same as if it completely lacked weakened sections. In other words, a carton wall that is "substantially free of" weakened sections may still actually contain one or more imperfections so long as there is no measurable effect upon the wall as a result thereof.

As used herein, the term "about" is used to provide flexibility to a numerical range endpoint by providing that a given value may be "a little above" or "a little below" the endpoint.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the recited values of about 1 inch to about 5 inches, but also include individual values and sub-ranges within the indicated range. This same principle applies to ranges reciting only one numerical value and should apply regardless of the breadth of the range or the characteristics being described.

The Invention

The present invention is directed to shipping cartons that are suitable for containing and shipping a wide variety of goods. The shipping cartons can be formed from a variety of materials, including, without limitation, fiberboard, cardboard, corrugated cardboard and others. While the cartons are generally sufficiently strong to endure all stages of packing, shipping and storage without prematurely rupturing, the present invention provides the cartons with features that allow operators to open the cartons and access the goods stored therein for further distribution without requiring (or benefiting from) sharp implements such as box cutters, utility knives, etc.

Figure 1B:
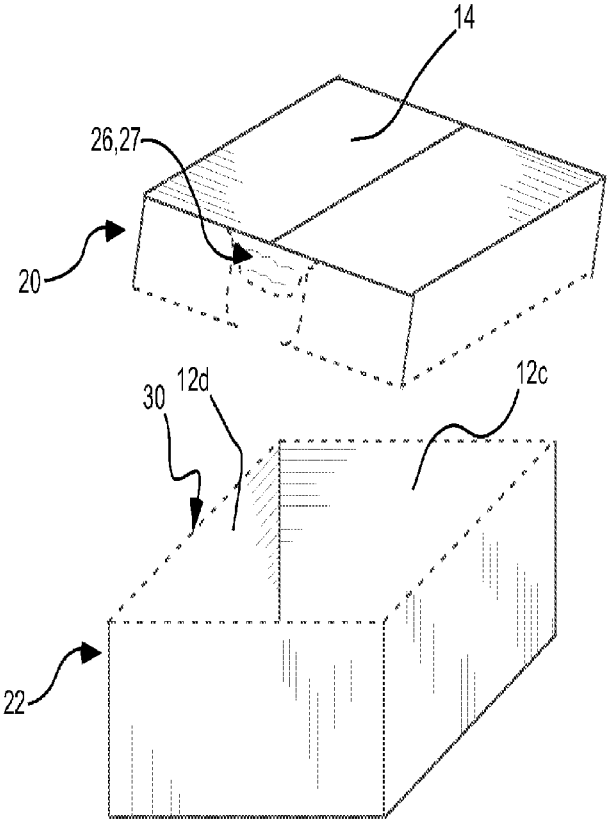
FIG. 1B is a perspective view of the shipping carton of FIG. 1A, shown with an upper portion and a lower portion separated from one another.
Figure 1C:
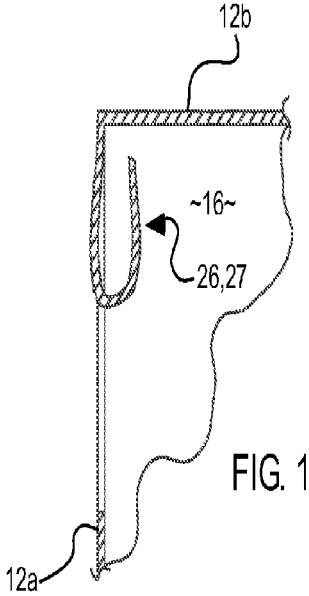
FIG. 1C is a partial, sectioned view of a portion of the carton of FIG. 1A, taken along section C-C of FIG. 1A, shown with a grip flap bent or rolled into a handle portion.

In the embodiment illustrated in FIGS. 1A-1C, a selectively frangible shipping carton 10 for storing and shipping goods (not shown) includes at least one side wall 12*a* (the carton in this aspect actually includes four side walls, 12*a*, 12*b*, 12*c* and 12*d*). The side wall 12*a* joins or connects a top wall 14 and a bottom wall 16 (partially visible in FIG. 1C). A path of weakness 18 can extend around a periphery of the carton through at least a portion of the side wall 12*a*. The path of weakness can enable a user to manually separate the carton into at least two portions: an upper portion 20 (which can include the top wall 14) and a lower portion 22 (which can include the bottom wall 16). A pair of lines of weakness 24*a* and 24*b* can extend upwardly relative to the path of weakness and can terminate at or adjacent the top wall 14.

An access flap 26 can be defined in the side wall between the pair of lines of weakness. The access flap can be operable to be moved (or, in some embodiments, removed) from the side wall to allow an operator to insert at least a portion of his or her hand or fingers through the side wall and into the interior of the carton to allow the operator to apply a generally upward force to the side wall to separate the upper portion 20 and the lower portion 22 from one another. In the embodiment of the invention illustrated in FIGS. 1A though 1C, the access flap 26 also serves as a grip flap 27 that can be graspable by the user when separating the carton into the at least two portions.

In a typical operation, the various paths, lines and areas of weakness of the carton 10 would be created or formed during the process of manufacturing the carton. The empty carton can then be provided to manufacturing or packaging centers and filled with goods (not shown), after which the carton would be closed or sealed manners well known in the art. In one embodiment, the top 14 and bottom 16 walls each include two or four flaps that are folded adjacent or over one another, and can then be taped or bonded (via the use of well known adhesives) closed to ensure that the goods are secured within the container.

When the carton arrives at the location where the goods are to be removed, an operator charged with opening the carton can relatively easily open the carton by first "knocking out," or separating from the side wall, the portion of material referred to herein as the grip flap 26. Once the grip flap has been separated from the side wall, the operator can then insert his or her hands, fingers, fingertips, etc. into the opening created by separating the grip flap from the side wall and apply an upward force that results in the upper portion 20 becoming separated from the bottom portion 22. Once the upper portion has been removed from the lower portion, the operator can freely access the goods (not shown) that have been transported in the shipping carton.

Advantageously, the operator can gain access to the goods without needing or benefiting from the use of a sharp blade, such as a box cutter or utility knife. This feature of the invention greatly reduces the risk of the operator inadvertently damaging goods while cutting the carton open, and greatly reduces the risk that the operator will seriously injure her- or him-self in the process.

As shown in FIG. 1C, the grip flap 26 can advantageously be manually configurable by the user into a graspable portion having a depth at least twice a thickness of the side wall. This can provide an intuitive "handle" that the operator can use when applying the separation force that will result in the upper portion 20 and lower portion 22 tearing or fracturing apart along the path of weakness 18. FIG. 1B illustrates the upper and lower portions in a completely separated condition. Thus, in this embodiment the path of weakness extends substantially completely around the periphery of the carton 10.

However, the path of weakness in other embodiments may extend only partially around the periphery of the carton. For example, it may be desirable, for a number of reasons, to gain access to the goods stored within the carton while not completely separating the upper portion from the lower portion. In this case, limiting the path of weakness from extending around one side (or more) of the carton will ensure that said side remains intact: resulting in the upper portion being hingedly coupled to the lower portion via said side. This can be advantageous, for example, in limiting the number of components that must be cleaned up and discarded after the carton has been opened.

The present invention also advantageously does not require the use of "zip" components seen in some prior art systems, which also result in multiple pieces of material requiring disposal after opening of the carton. Additionally, the present invention can significantly reduce user costs, as the distribution center (in one example) needn't keep on hand and maintain cutting devices such as box cutters and utility knives that require frequent blade replacement. Also, as the present invention obviates the need for cutting devices, the safety of users is greatly enhanced. Further, users of the present invention may not need to wear heavy gloves for protection from cutting instruments. As such, the users can more easily grasp and lift boxes using no gloves at all, or using gloves better designed for such lifting and carrying purposes rather than gloves designed for blade protection purposes.

As will be appreciated, the lines of weakness 24*a* and 24*b* can be separated a distance sufficiently wide to functionally receive all or most of the user's fingers (not shown) between the pair of lines of weakness. In many embodiments, the lines of weakness are separated a sufficient distance to receive the user's hand or finger(s) even if the user is wearing a protective glove. In this manner, a user can securely grasp the grip flap when separating the upper portion of the carton from the lower portion to maximize the amount of force applied to the upper portion via the grip flap. An access point 32 can be formed or formable in or adjacent the grip flap, to allow or aid a user in initiating separation of the grip flap from the side wall with a fingertip.

In the embodiment illustrated in FIG. 1A, the grip flap or access flap 26, 27 includes a secondary area of weakness 29 formed therein. The secondary area of weakness can aid or enable the grip flap to be easily folded or rolled upon itself to provide a graspable portion having a depth at least twice a thickness of the side wall. Thus, the secondary area of weakness can result in the grip flap naturally "curling" into a handle portion that can be easily grasped by a user.

While the path of weakness can be formed in a variety of locations on (and around) the carton, and in a variety of paths, in one aspect (best seen in FIG. 1B), the lower portion 22 includes an upper periphery edge 30 formed after separation of the upper and lower portions. The upper periphery edge can have a substantially constant elevation relative to a lowermost point of the lower portion. In other words, the upper periphery edge is substantially straight, and includes edges that are substantially parallel to one another around the periphery of the lower portion.

In one aspect of the invention, each of the pair of lines of weakness 24*a*, 24*b* is in communication with, and extends upwardly from, the path of weakness 18. In this manner, the grip flap 27 can be formed immediately adjacent the path of weakness to aid an operator in cleanly separating the upper and lower portions along the path of weakness. Also, in one embodiment, each of the pair of lines of weakness can terminate at or adjacent to the top wall 14. In this manner, the operator is applying force almost directly to the top wall to improve his or her ability to separate the upper portion from the lower portion.

In other embodiments (for example, the carton 10*c* of FIG. 3B), the grip flap or access flap can be formed in the side wall in a location below the top wall, with an expanse of side wall being present between the grip flap and the top wall. In this embodiment, the side wall can be formed so that no areas of weakness exist in the side wall between the grip flap and the top wall. In this manner, the portion of the side wall between the grip flap and the top wall does not tend to yield or buckle in response to the force applied by the user to the grip flap.

Figures 2A, 2B, 2C:
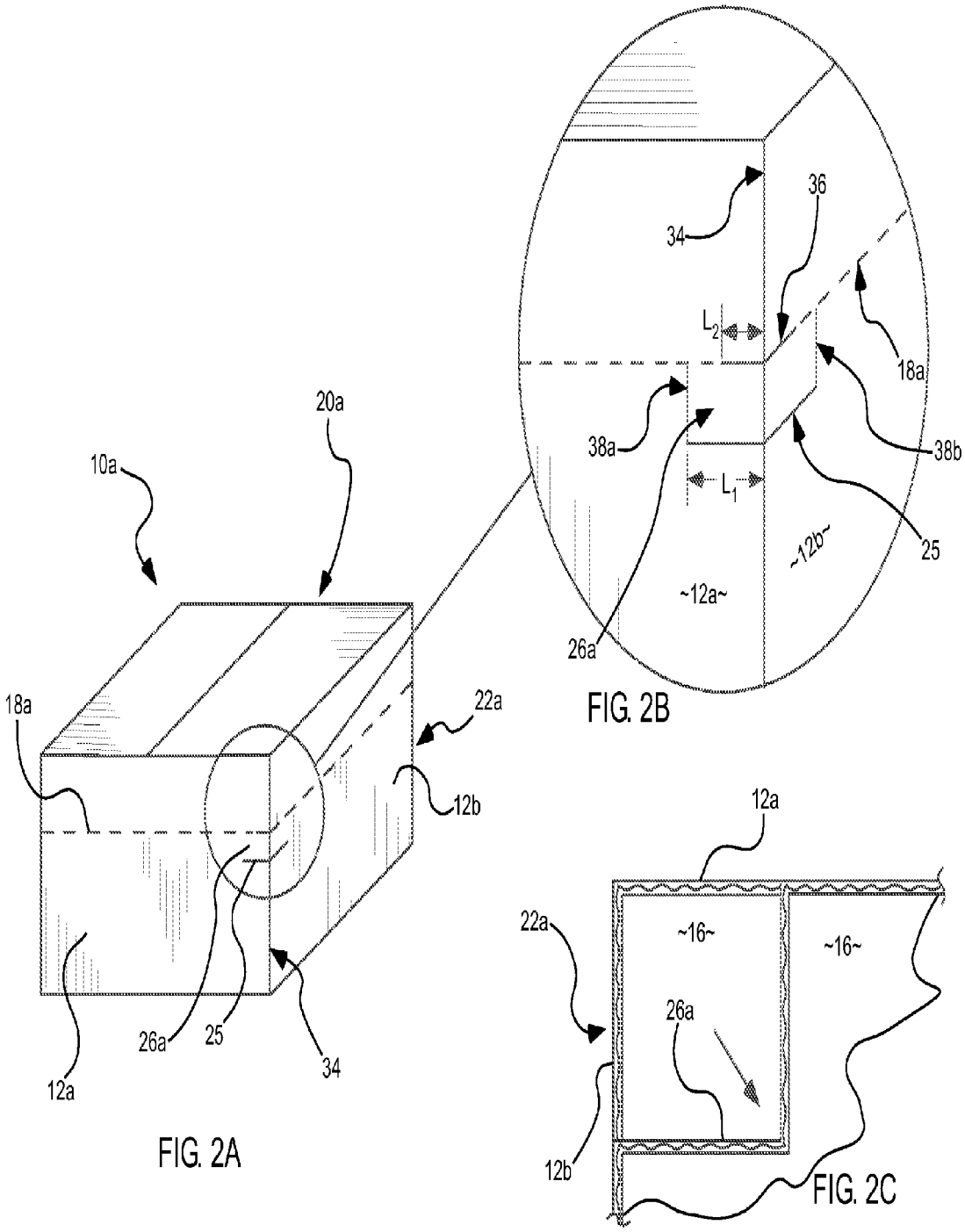
FIG. 2A is a perspective view of a shipping carton in accordance with another aspect of the invention.
FIG. 2B is a more detailed view of a portion of the shipping carton of FIG. 2A.
FIG. 2C is a top view of a lower portion of the carton of FIG. 2A (after the lower portion has been separated from the upper portion), shown with an access flap bent inwardly into the carton.

In the embodiment of the invention illustrated in FIGS. 2A through 2C, an access flap 26*a* is formed in side wall 12*a*. A path of weakness 18*a* can extend around a periphery of the carton 10*a* through at least a portion of the side wall. As in other embodiments, the path of weakness can enable a user to manually separate the carton into at least two portions: an upper portion 20*a* and a lower portion 22*a*. A line of weakness 25 can be spaced from the path of weakness and can extend generally parallel to the path of weakness. An access flap 26*a* can be defined in the side wall between the line of weakness and the path of weakness. The access flap can allow the user to insert at least a portion of the user's hand within the carton to allow the user to securely grasp the side wall when separating the carton into the at least two portions.

While not so required, in the aspect shown, the line of weakness can extend around a corner 34 of the carton so as to be present in two adjoining side walls (in this case side walls 12*a* and 12*b*) of the carton 10*a*. The access flap 26*a* defined between line of weakness 25 and the path of weakness 18*a* can moved by the operator to gain a leveraged grip on the upper portion 20*a* of the carton to allow the operator to separate the upper portion from the lower portion 22*a*. In the embodiment, shown, the access flap 26*a* is configured to fold or bend inward along the corner 34 of the carton.

The carton 20*a* can originally be provided with the access flap 26*a* assuming the same plane as each respective side wall, 12*a* and 12*b* (e.g., a portion of the access flap is coplanar with each side wall). When the operator desires to gain access to the carton, he or she can fold or bend the access flap into the position illustrated in FIG. 2C, where it can be seen that the access flap is now nearly completely contained within the internal portion of the carton (note that FIG. 2C is shown with the upper portion 20*a* separated from the lower portion 22*a*, e.g., the upper portion is not visible).

In one aspect of the invention, the line of weakness 25 can be formed such that the side wall 12*a* (and/or the side wall 12*b*) has a cohesive strength of substantially zero at the line of weakness. In other words, in this embodiment, the line of weakness is a cut or slit formed substantially all of the way through the material of the side wall. In this manner, the line of weakness poses almost no resistance to the separation of the access flap from the side walls 12*a*, 12*b*. The present inventor has found that forming the line of weakness in such a manner increases the ease with which an operator can initiate separation of the upper portion from the lower portion, while not appreciably affecting the overall integrity of the carton.

As shown in FIGS. 2A through 2C, the path of weakness 18*a* can include a weakened section 36 that can include a cohesive strength that is less than a cohesive strength of other portions of the path of weakness. The path of weakness can be more easily torn or separated at the weakened section 36 than in other portions of the path of weakness. In one embodiment of the invention, the weakened section is formed at the corner 34 of the carton in a generally parallel relationship with the line of weakness 25. In this manner, the access flap 26*a* can be relatively easily "popped" inward with a sharp jab, after which the operator can insert at least a portion of his or her fingers or hands inside the container and manually separate the upper portion 20*a* and the lower portion 22*a* from one another.

The weakened section 36 can be formed similarly to the line of weakness 25 by formation of a cut or slit substantially completely through the side walls 12*a*, 12*b*, such that the side walls have a cohesive strength of substantially zero in this localized area. Of course, the weakened section 36 and the line of weakness 25 can vary in terms of reducing cohesive strength of the side wall in the localized area of the weakened section and line of weakness, from a substantially zero cohesive strength (e.g., cut completely through) to nearly no reduction in cohesive strength (e.g., only a very light cut).

In the embodiment illustrated in FIGS. 2A through 2C, the weakened section 36 can include a length $L_2$ that is shorter than a length $L_1$ of the line of weakness 25. Also, at least one fold line (two are shown, 38*a* and 38*b*) can extend from the weakened line to the weakened path. The fold lines can allow the access flap to bend or fold away from the side wall to allow the user to insert at least a portion of the user's hand within the carton. The fold lines can aid in creating the condition shown in FIG. 2C, in which the access flap 26*a* folds or bends neatly and easily into an angled configuration when the access flap is in an access configuration. In this manner, the access flap can remain attached to the side wall in two locations, even when oriented into the access configuration shown in FIG. 2C.

Figure 3A:
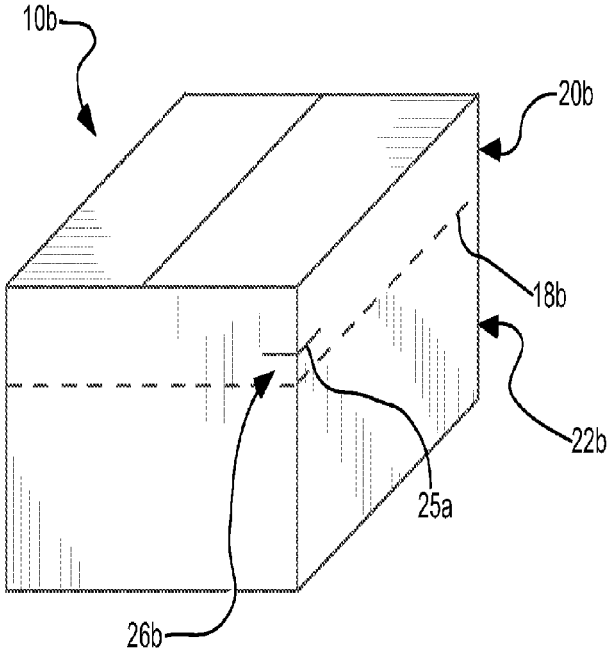
FIG. 3A is a perspective view of another shipping carton in accordance with an embodiment of the invention.
Figure 3B:
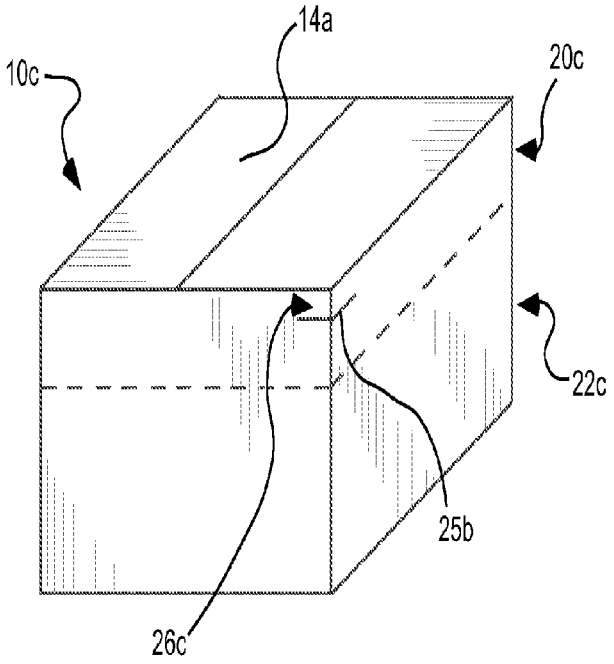
FIG. 3B is a perspective view of yet another shipping carton in accordance with an embodiment of the invention.

FIGS. 3A and 3B illustrate alternate embodiments of the invention, with the line of weakness 25*a* of carton 10*b* of FIG. 3A being formed in a location that is above the path of weakness 18*b*. In this embodiment, the access flap 26*b* will remain a part of the upper portion 20*b* when it is separated from the lower portion 22*b*. In the embodiment of the invention illustrated in FIG. 3B, the line of weakness 25*b* is formed adjacent the top wall 14*a* such that the access flap 26*c* is adjacent the top wall. In this embodiment, the force applied by the operator to separate the upper 20*c* and lower 22*c* portions will be directed almost directly through the top wall, without any intervening side wall structure.

The various paths of weakness 18, 18*a*, 18*b*, etc., discussed herein are shown primarily in the figures as being located approximately ⅔ of the distance from the bottom wall 16 to the top wall 14 of the various cartons 10, 10*a*, etc. It is to be understood, however, the vertical elevation of the path of weakness can vary. In some aspects of the invention, the path of weakness is formed at the joint between the top wall and the various side walls. In other embodiments, it can be located at the joint between the bottom wall and the various side walls. The acceptable range of elevation can vary through all ranges between these two.

Similarly, while the exemplary cartons shown in the figures are rectangular in shape, it is to be understood that the carton can include a variety of shapes including, without limitation, square, triangular, round, elongate, etc.

Generally, the path or paths of weakness will not significantly affect the performance of the carton in protecting the product through the rigors of handling and distribution. In one aspect of the invention, the parameters of the various paths, lines or areas of weakness can be altered, based on the material of the carton and the desired strength of the carton, to provide a path of weakness that will enable relatively easy separation of the upper and lower portions while maintaining an adequate overall integrity of the carton.

For example, the perforation slits, cuts or holes can be increased in size and/or frequency (or changed in shape or orientation), to increase a relative ease with which the portions of the carton can be separated at the path of weakness (e.g., to decrease a cohesive strength of the carton at the path of weakness). This decrease in cohesive strength will generally not be sufficient to negatively impact the overall performance of the carton: that is, the carton will remain intact throughout the various packaging, shipping, handling, etc., phases of the carton until the user intentionally separates the portions of the carton.

In addition to the structural features discussed above, the present invention also provides a method for manually separating an upper portion of a shipping carton from a lower portion of the shipping carton to expose a storage area of the shipping carton, comprising: separating a grip flap from a side wall of the carton by rupturing a pair of lines of weakness defining the grip flap in the side wall; rolling or folding the grip flap into a graspable portion having a depth at least twice a thickness of the side wall; applying a force to the side wall, through the graspable portion, to manually separate an upper portion of the carton from a lower portion of the carton along a path of weakness formed in the side wall between the upper portion and the lower portion.

Rolling or folding the grip flap into a graspable portion having a depth at least twice a thickness of the side wall can include inserting or placing one or more of a user's fingers between the pair of lines of weakness, to allow the user to securely grasp the grip flap when separating the upper portion of the carton from the lower portion of the carton.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method for manually separating an upper portion and a lower portion of a shipping carton having at least one side wall joining a top wall and a bottom wall to expose a storage area of the shipping carton, comprising:

separating a grip flap from the side wall of the carton by rupturing a pair of lines of weakness defining the grip flap in the side wall;

rolling or folding the grip flap into a graspable portion having a depth at least twice a thickness of the side wall;

applying a force to the side wall, through the graspable portion, to manually separate the upper portion of the carton from the lower portion of the carton along a path of weakness formed in the side wall between the upper portion and the lower portion and having a substantially constant elevation relative to a lowermost point of the carton, wherein the pair of lines of weakness extends upwardly relative to the path of weakness and terminates at a joint between the top wall and the side wall.

2. The method of claim 1, wherein rolling or folding the grip flap into a graspable portion having a depth at least twice a thickness of the side wall includes one or more of a user's fingers between the pair of lines of weakness, to allow the user to securely grasp the grip flap when separating the upper portion of the carton from the lower portion of the carton.

3. The method of claim 1, wherein the grip flap includes a secondary area of weakness formed therein, the secondary area of weakness enabling the grip flap to be easily folded or rolled upon itself to provide a graspable portion having a depth at least twice a thickness of the side wall.

4. The method of claim 1, wherein the lines of weakness are separated a distance sufficiently wide to receive a user's fingers between the pair of lines of weakness, to allow the user to securely grasp the grip flap when separating the upper portion of the carton from the lower portion of the carton.

5. The method of claim 1, wherein the lower portion includes an upper periphery edge formed after separation of the upper and lower portions, the upper periphery edge having a substantially constant elevation relative to a lowermost point of the lower portion.

6. The method of claim 1, wherein each of the pair of lines of weakness is in communication with, and extends upwardly from, the path of weakness.

7. The method of claim 1, wherein the grip flap includes at least one access opening formed or formable therein, the access opening allowing a user to initiate separation of the grip flap from the side wall with a fingertip.

8. The method of claim 1, wherein the separation of the upper portion of the carton from the lower portion of the carton is performed manually without the use of a sharp implement.

9. The method of claim 1, wherein the path of weakness has a constant elevation relative to a lowermost point of the carton.

* * * * *